US008414208B1

(12) United States Patent
Bosler

(10) Patent No.: US 8,414,208 B1
(45) Date of Patent: Apr. 9, 2013

(54) WRITING IMPLEMENT USING THUMB AND ONE FINGER

(76) Inventor: James Thomas Bosler, San Francisco, CA (US)

( * ) Notice: Subject to any disclaimer, the term of this patent is extended or adjusted under 35 U.S.C. 154(b) by 320 days.

(21) Appl. No.: 12/927,737

(22) Filed: Nov. 22, 2010

Related U.S. Application Data

(60) Provisional application No. 61/338,409, filed on Feb. 18, 2010.

(51) Int. Cl.
*A46B 5/02* (2006.01)

(52) U.S. Cl.
USPC ..... 401/6

(58) Field of Classification Search ..... 401/6, 7, 401/88
See application file for complete search history.

(56) References Cited

U.S. PATENT DOCUMENTS

| | | | | |
|---|---|---|---|---|
| 945,026 | A | 1/1910 | Faust | |
| 1,273,697 | A | 7/1918 | Vidal | |
| 1,879,456 | A | 10/1930 | Parsons | |
| 1,793,945 | A * | 2/1931 | Mauthe | 401/6 |
| 2,173,451 | A * | 9/1939 | Lorber | 401/6 |
| 2,440,913 | A * | 5/1948 | Pate | 401/96 |
| 3,019,769 | A | 2/1962 | Elballard | |
| 4,832,604 | A * | 5/1989 | Rusk | 434/166 |
| 5,310,345 | A | 5/1994 | Gershon | |
| D359,758 | S * | 6/1995 | Inami | D19/55 |
| 6,203,225 | B1 | 3/2001 | Baudino et al. | |
| 6,390,704 | B1 * | 5/2002 | Baudino et al. | 401/6 |
| 7,789,580 | B2 | 9/2010 | Cheng | |

FOREIGN PATENT DOCUMENTS

| | | | |
|---|---|---|---|
| EP | 0710575 | A1 | 5/1996 |

* cited by examiner

*Primary Examiner* — David Walczak

(57) ABSTRACT

A finger grip for a writing instrument such as a pen or pencil, which has an external concave depression for receiving the ball of a middle finger, and a longitudinal bore through its center which is threaded to screw upon the barrel of any handwriting instrument which has been externally threaded to accommodate it. The depression provides stability and comfort while using only the thumb and middle finger to write. The passive exclusion of the index finger from the process of gripping and moving the instrument provides a simpler dexterous hand coordination which can result in improved and faster handwriting.

1 Claim, 1 Drawing Sheet

WRITING IMPLEMENT USING THUMB AND ONE FINGER

CROSS-REFERENCE TO RELATED APPLICATIONS

This application claims the benefit of provisional patent application Ser. No. 61/338,409 filed Feb. 18, 2010 by the present inventor.

BACKGROUND OF THE INVENTION

Prior Art

Typical writing instruments such as pens and pencils have a long, tubular barrel, requiring the writer's thumb and two fingers to stabilize it and move it along. For various reasons however such as arthritis or the loss of hand coordination as often comes with age, it can become difficult to move the thumb and fingers in concert in order to write legibly. This problem is facilitated by opting to coordinate only two digits, i.e. the thumb and middle finger, instead of the three, a trait sometimes observed in diners where the waiters have to write down orders quickly and legibly.

One difficulty in doing so, however, is that the barrel is much more prone to slipping out of one's grip. Another is that the middle finger bears more barrel pressure, making writing less comfortable. These difficulties can be alleviated to various extents by using one of many prior art finger grips. One such is a cylinder of resilient, rubbery material installed on the barrel, discussed in U.S. Pat. No. 6,273,626. Another of note is the grip of European Patent EP0710575, a barrel cover with at least one concave depression for accommodating, rather, one's index finger. Such grips only partially alleviate however because they are not designed specifically for two-digit writing (and are not presented as suitable for that purpose). The latter example accommodates the index finger in a three-digit grip; the stronger middle finger however can be more suitable for two-fingered writing.

Objects and Advantages

This invention has been developed to seat the middle finger more securely by means of a concave depression located upon a finger grip attachment to the barrel whereon that finger could rest. The index finger would simply not be used, or used to a lesser extent, so allowing the writer to concentrate more on the thumb and finger in use.

Two-digit writing is best performed with a secure grip, which is facilitated by the positioning of the finger depression along the barrel as is most suitable to the particular writer. This invention provides a means of adjusting its position by screwing the attachment up and down the barrel. Most prior art finger grips such as those mentioned above lack such means, short of pulling and twisting it along the barrel with a concentrated effort toward accurate placement.

Also, a writer can keep the writing point sharp by occasionally rotating the attachment upon the barrel. Most prior art finger grips lack such means as well.

SUMMARY

In accordance with the present invention, an internally screw-threaded finger grip attachment for an externally screw-threaded prior-art tubular barrel of a writing instrument, indented into which is a concave depression for accommodating the middle finger of the writer.

DRAWINGS

Figures

FIRST EMBODIMENT

FIG. 1—Description

Figure 1:
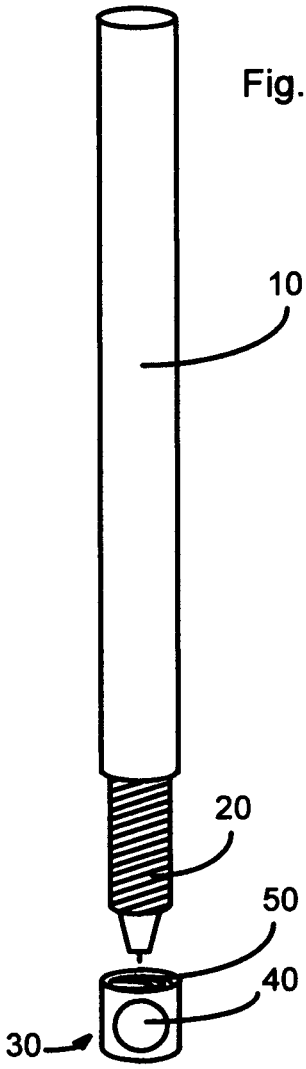
FIG. 1 is a perspective view of a first embodiment of my invention, a prior-art writing pen barrel which is externally screw-threaded, and an internally screw-threaded tubular attachment which is externally indented with a finger depression.
Figure 2:
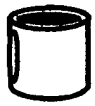
FIG. 2 is a perspective side view of the attachment.

The first embodiment is shown in FIG. 1. Upon the barrel 10 of a prior-art writing instrument is an externally screw-threaded portion 20 to accommodate a tubular attachment 30 which has internal screw threads 50, and upon which is a depression 40 for accommodating the ball of a handwriter's middle finger, that fleshy volar pad of the distal phalange. A side view of the attachment is shown in FIG. 2.

FIRST EMBODIMENT

FIG. 1—Operation

The user initially readies the writing instrument 10 for initial use by screwing the attachment 30 along its threaded portion 20 to that position deemed most comfortable when holding the instrument in the manner customary to writing and with the ball of the middle finger in the depression 40. The user then grasps the instrument in that manner and writes.

FIRST EMBODIMENT

FIG. 1—Advantages

The depression facilitates a thumb and one-finger grip of the writing instrument rather than the thumb and two-finger grip which writers otherwise apply, thus providing a simpler dexterous combination for better handwriting.

The ability of the attachment to be adjusted higher or lower on the barrel allows the writer to position the depression for maximum comfort and so as to avoid writer's cramp. If a pencil then one may rotate the attachment during use in order to wear down its lead more uniformly on all sides, thus maintaining a sharp point. The writing instrument can be comfortably used by another writer as well. Also, the ability of the attachment to be removed allows the substitution of attachments of other styles to suit various preferences as to grip, as further discussed below.

SECOND EMBODIMENT

FIG. 3—Description

Figure 3:
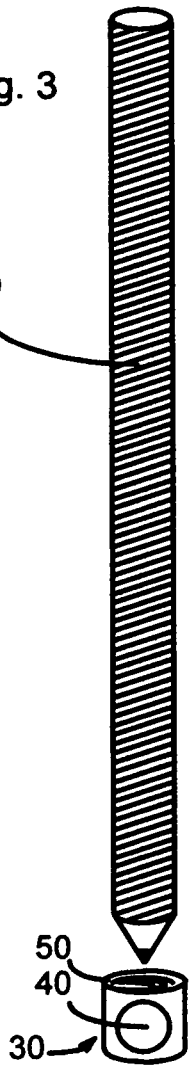
FIG. 3 is a perspective view of a second embodiment, a prior-art wooden pencil barrel which is externally screw-threaded, and an internally screw-threaded tubular attachment which is externally indented with a finger depression.

The second embodiment is shown in FIG. 3. The barrel 60 of a prior-art wooden pencil is screw-threaded to accommodate a tubular attachment 30 which has internal screw threads

50 running its length, and upon which is a depression 40 for accommodating the ball of the handwriter's middle finger, that fleshy volar pad of the distal phalange. A side view of the attachment is shown in FIG. 2.

SECOND EMBODIMENT

FIG. 3—Operation

The user initially readies the writing instrument 60 for initial use by screwing the attachment 30 along its barrel to that position deemed most comfortable when holding the instrument in the manner customary to writing and with the ball of the middle finger in the depression 40. The user then grasps the instrument in that manner and writes, occasionally rotating the attachment 30 as necessary to maintain the sharpness of the writing point.

SECOND EMBODIMENT

FIG. 3—Advantages

The depression facilitates a thumb and one-finger grip of the writing instrument rather than the thumb and two-finger grip which writers otherwise apply, thus providing a simpler dexterous combination for better handwriting.

The ability of the attachment to be adjusted higher or lower on the barrel allows the writer to position the finger depression for maximum comfort in order to avoid writer's cramp. The attachment is simply repositioned higher up the barrel as the pencil requires sharpening. Occasionally rotating the attachment during use maintains a sharp writing point. The writing instrument can be comfortably used by other writers as well. Also, the ability of the attachment to be removed allows it to be used again on other such pencils, and allows for the substitution of attachments of other styles to suit the writer's preference.

CONCLUSIONS, RAMIFICATIONS, AND SCOPE

Thus the reader will see that at least one embodiment of this writing implement provides a means to write with simpler hand coordination by using one's thumb and just one finger rather than two.

Although the descriptions of these embodiments contain many specifics, they should not be construed as limitations on the scope, but rather as an exemplification of two embodiments thereof. Many other variations are possible. One is in which the attachment is permanently installed on the barrel during its manufacture, in order to prevent its loss. Other variations have finger depressions of various shapes, such as oval finger depressions at various angles relative to the barrel in order to accommodate either left or right handed writers. Others have oval finger depressions of various lengths, widths and depths, allowing one to roll the barrel between thumb and finger to optimally reduce the frequency of repositioning one's hand upon a page or to reduce writer's cramp. Still other variations have external shapes of the attachment that are other than tubular, such as oval or triangular.

Accordingly, the scope should be determined not by the embodiments illustrated, but by the appended claims and their legal equivalents.

I claim:

1. A writing device for enabling a user to grip the writing device with the user's thumb and middle finger comprising:

a writing instrument having an outer barrel and an inner writing medium, said outer barrel including an exteriorly threaded section having a length extending along a substantial portion of a non-tapered length of said outer barrel, and a cylindrical tubular attachment having an internally threaded section which mates with said externally threaded section of said outer barrel, said tubular attachment having an overall length shorter than said length of said exteriorly threaded section such that said tubular attachment can be threaded along said length of said barrel to thereby adjust a longitudinal positioning of said tubular attachment along said length of said barrel, said tubular attachment further including a single concave depression on an exterior surface thereof for receiving a tip of the user's middle finger wherein a user may grasp the writing device between the user's thumb and middle finger.

* * * * *